United States Patent [19]

Rydborn

[11] 4,398,568

[45] Aug. 16, 1983

[54] APPARATUS FOR STOPPING AND RESETTING A LOOM

[76] Inventor: Sten A. O. Rydborn, Klöxhultsvägen 21, 343 00 Älmhult, Sweden

[21] Appl. No.: 250,326

[22] Filed: Apr. 2, 1981

Related U.S. Application Data

[63] Continuation of Ser. No. 80,904, Oct. 1, 1979.

[30] Foreign Application Priority Data

Oct. 20, 1978 [SE] Sweden ..... 781093

[51] Int. Cl.[3] ..... D03D 47/00

[52] U.S. Cl. ..... 139/1 R; 139/1 E; 139/116; 139/453

[58] Field of Search ..... 139/1 E, 1 R, 116, 336, 139/370.2, 450, 453

[56] References Cited

U.S. PATENT DOCUMENTS 2,703,591 3/1955 Sepavich ..... 139/372

3,805,850 4/1974 Duynhoven et al. ..... 139/1 E

*Primary Examiner*—Henry Jaudon

*Attorney, Agent, or Firm*—Beveridge, De Grandi & Kline

[57] ABSTRACT

An apparatus for stopping and resetting a loom. The technical problem which lies at the foundation of the present invention is to provide an apparatus for stopping and resetting a loom to a certain position before a weft stroke which has given an indication of breakage. This technical problem is solved according to the present invention in that a weft fork which senses the weft, and, in the event of a predetermined breakage type in the movement of the weft during a sensing period emits a signal for stopping the loom, is arranged to prevent gripping of a new weft after the generation of a breakage signal, whereby the rapier or rapiers execute one or more strokes without a weft.

1 Claim, 2 Drawing Figures

APPARATUS FOR STOPPING AND RESETTING A LOOM

This is a continuation of application Ser. No. 80,904, filed Oct. 1, 1979.

BACKGROUND OF THE DISCLOSURE

The present invention relates to an apparatus for stopping and resetting a loom at a certain position in the event of a weft stroke which has given an indication of a breakage.

In modern looms, the stroke speed is very high. In, for example, shuttleless looms the stroke speed may be as high 600 strokes per min., and it is normally approximately 200–250 strokes per min. Shuttleless looms have rapiers either on one side of the loom or on both sides of the loom. With rapiers on only one side, the weft is gripped at the weft selector and is moved all the way across to the other side of the loom, and, with rapiers on both sides of the loom, the weft is gripped by one rapier at one side of the weft selector and is moved approximately to the middle of the loom where the weft is taken over by a rapier from the other side of the loom and moved out to that side. This operation takes place at such high speed that the first rapier is located at the selector for gripping a new weft roughly at the same time as the second rapier has reached a position at the loom edge and is to release the weft. If a weft breakage is indicated by means of a weft fork, particularly at the end of the movement of the second rapier towards the loom edge, the first rapier will have time to grip a new weft from the selector and draw this into the loom before the weft fork has had time to stop the loom. In many cases, the first rapier has had time to pass on its weft to the second rapier and this will also have had time to pull out the weft to the loom edge before the loom has stopped. In this manner that weft which gave the indication of breakage will be woven into the fabric. Thus, a program advancement, a shaft switch and possibly also a weft advancement may take place before the loom stops after a weft breakage. This entails great inconveniences and long down-times, since high-quality fabrics require resetting to the broken weft and replacement thereof by a whole weft in order that the resultant fabric need not be downgraded to a lower quality or second assortment. In the weaving operation, there is, naturally, always a balancing between the time which is consumed for resetting after one or more weft breakages during a certain running time for the loom and the quality of the weaving results.

SUMMARY OF THE INVENTION

It is desirable to reduce the resetting time after a breakage so that it is as short as possible. One object of the present invention is to obviate the above-mentioned inconveniences and, to as high a degree as possible, to reduce down-time after a weft breakage or an indication of a weft breakage.

This object is satisfied according to the present invention in that the apparatus of the invention is characterized by a weft fork which senses the weft and, in the event of a predetermined breakage type in the movement of the weft during a sensing period, emits a signal for stopping the loom and which, is arranged to prevent gripping of a new weft after the generation of a breakage signal, whereby the rapier or rapiers are arranged to execute one or more strokes without a weft.

As a result of the present invention, the down-time of the loom due to a weft breakage signal is reduced.

BRIEF DESCRIPTION OF THE DRAWINGS

These and other aspects and advantages of the invention will be more apparent from the following detailed description and claims, particularly when considered in conjunction with the drawing which is a block diagram of the invention.

DETAILED DESCRIPTION

Figure 1:
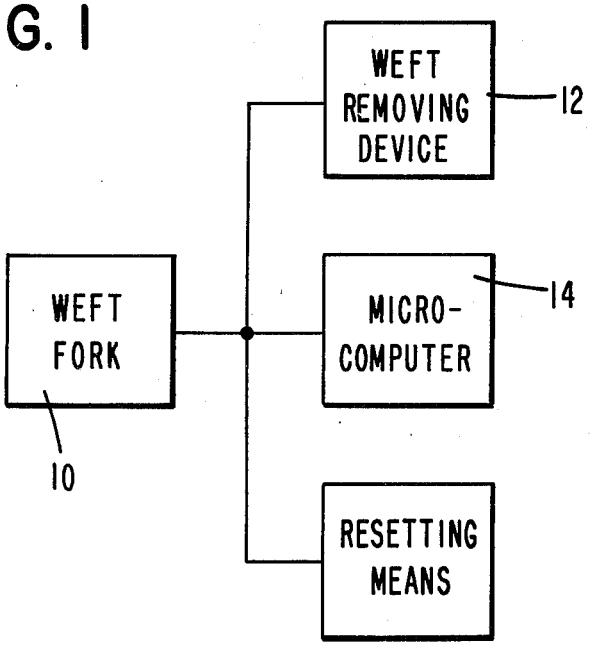
FIG. 1 is a block diagram of certain components of the invention.
Figure 2:
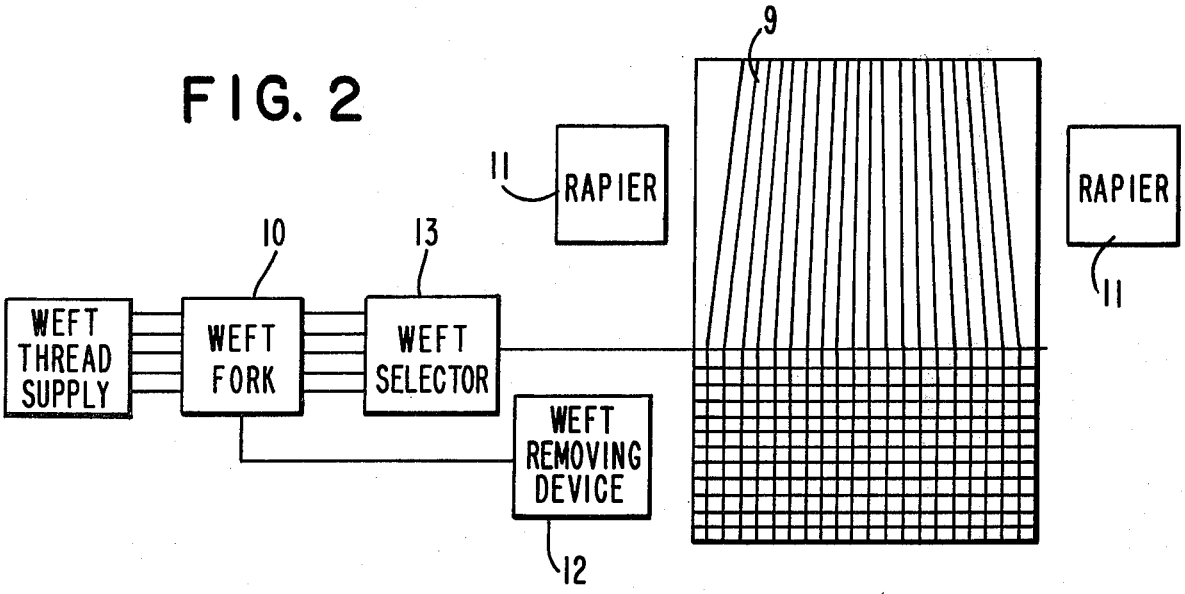
FIG. 2 is a more detailed block diagram of the invention.

According to the invention, a weft fork 10, in, for example, a loom 9 with rapiers 11 on both sides of the loom is coupled to a device 12 at the weft selector 13 of the loom. The device 12 is disposed, after receipt of a breakage signal from the weft fork 10, very rapidly by means of, for example, spring force, to knock away that weft which is about to be gripped in the stroke or strokes after an indication of breakage. As a result, the rapier or rapiers 11 will execute a stroke without a weft, whereby the weft with the breakage or that which has given an indication of breakage will not be woven in with the subsequent weft. Such would otherwise have been the case, since the mechanical parts of the loom do not have time to stop immediately after a breakage signal because of their mechanical inertia and because of the high working speed of the loom.

In order to shorten down-time after a stoppage of the loom, the weft fork device 10 according to the invention is coupled to a microcomputer 14 which is programmed moreover to back up the shaft adjustment and the program and also the weave advancement to their positions before that weft during which the weft fork device generated a breakage signal.

I claim:

1. In a shuttleless loom including means for holding warp threads, means for holding weft threads, a weft selector for moving a selected weft thread to a gripping position, at least one rapier for gripping the selected thread at the gripping position and moving with the gripped thread across the loom and through the warp shed to form woven material on the loom, and weft signaling means for sensing the movement of weft thread from the weft holding means to the gripping position and across the loom and for generating a signal in the absence of such movement, the improvement comprising means responsive to the signal from the weft signaling means at the time the rapier is moving across the loom for preventing the weft selector from moving the selected weft thread to the gripping position to prevent the rapier from gripping the thread, whereby the rapier moves across the loom without the weft thread.

* * * * *